US006047571A

United States Patent [19]

Juniman

[11] Patent Number: 6,047,571

[45] Date of Patent: Apr. 11, 2000

[54] CONVERTIBLE STOCKINGS

[76] Inventor: David Juniman, 213 Old York Rd., Jenkintown, Pa. 19046

[21] Appl. No.: 08/327,147

[22] Filed: Oct. 21, 1994

Related U.S. Application Data

[63] Continuation of application No. 08/106,807, Aug. 16, 1993, which is a continuation of application No. 07/891,039, Jun. 1, 1992, abandoned.

[51] Int. Cl.[7] ..... A41B 11/02; D04B 9/46

[52] U.S. Cl. ..... 66/178 A; 66/177; 66/185; 2/239

[58] Field of Search ..... 66/177, 185; 2/409, 2/239

[56] References Cited

U.S. PATENT DOCUMENTS

| | | | |
|---|---|---|---|
| 2,826,760 | 3/1958 | Rice | 2/239 X |
| 2,968,937 | 1/1961 | Margulies | 2/239 X |
| 3,090,963 | 5/1963 | Wittman | 2/239 |
| 4,756,027 | 7/1988 | Buenos et al. | 2/239 X |
| 5,067,179 | 11/1991 | Wormser | 2/239 X |

*Primary Examiner*—Danny Worrell

*Attorney, Agent, or Firm*—J.P. Blasko Professional Corp.; John P. Blasko

[57] ABSTRACT

A convertible stocking for use by dancers is disclosed. The stocking may be converted from a footed to footless stocking without changing the stocking. The stocking has a main tubular portion, a toe pocket portion, and a foot opening collar. The main tubular portion is knitted in a continuous, circular manner to form a substantially uniform knit tube having a border at one end. The toe pocket portion is knitted in a continuous, reciprocating manner onto about one half of the border of the main tubular portion using successive courses of yarn beginning with about one half the total number of knitting needles of the knitting machine and progressively decreasing the number of knitting needles used to knit each course and then increasing the number of knitting needles to about one half the total number of knitting needles thereby forming a knitted pocket over about one half the border of the main tubular portion. The pocket has a terminating edge. The foot opening collar comprises a tubular collar knitted in a continuous, circular manner to the remaining half of the border of the main tubular portion and to the edge of the toe pocket portion. The stocking is constructed in a manner that permits efficient manufacturing of the stocking. Dancer tights may be formed by sewing or knitting a pair of convertible stockings together.

8 Claims, 4 Drawing Sheets

CONVERTIBLE STOCKINGS

This is a continuation of application Ser. No. 08/106,807 filed on Aug. 16, 1993, which is a continuation of application Ser. No. 07/891,039 filed on Jun. 1, 1992, now abandoned.

BACKGROUND OF THE INVENTION

The present invention relates to stockings for use by dancers, more particularly, convertible stockings.

Dancers usually wear footless stockings or tights when they are training in ballet shoes and footed stockings or tights when training in pointe shoes. Since dancers usually train in both types of shoes during a given training session, changing between footless and footed tights presents a considerable inconvenience for the dancers.

It is therefore an object of this invention to provide a stocking and tights that could be used with both ballet and pointe shoes without removing or changing the stocking or tights when changing shoes.

It is also an object of the invention to provide a stocking or tights that achieve the aforementioned object and which may be conveniently and economically manufactured.

It is also an object of the invention to provide a knitted convertible stocking which may be conveniently knitted on a continuous tubular knitting machine with reciprocating cylinders and which does not require a boarding operation to form the toe or heel portion of the stocking.

SUMMARY OF THE INVENTION

A convertible stocking for use by dancers is disclosed. The stocking may be converted from a footed to footless stocking without changing the stocking. The stocking is constructed in a manner that permits efficient manufacturing of the stocking. Dancer tights may be formed by sewing or knitting a pair of convertible stockings together. The invention comprises a tubular seamless stocking knitted on a circular knitting machine with reciprocating cylinders. The stocking has a main tubular portion, a toe pocket portion, and a foot opening collar. The main tubular portion is knitted in a continuous, circular manner to form a substantially uniform knit tube having a border at one end. The toe pocket portion is knitted in a continuous, reciprocating manner onto about one half of the border of the main tubular portion using successive courses of yarn beginning with about one half the total number of knitting needles of the knitting machine and progressively decreasing the number of knitting needles used to knit each course and then increasing the number of knitting needles to about one half the total number of knitting needles thereby forming a knitted pocket over about one half the border of the main tubular portion. The pocket has a terminating edge. The foot opening collar comprises a tubular collar knitted in a continuous, circular manner to the remaining half of the border of the main tubular portion and to the edge of the toe pocket portion.

DESCRIPTION OF THE PREFERRED EMBODIMENT

Figure 1:
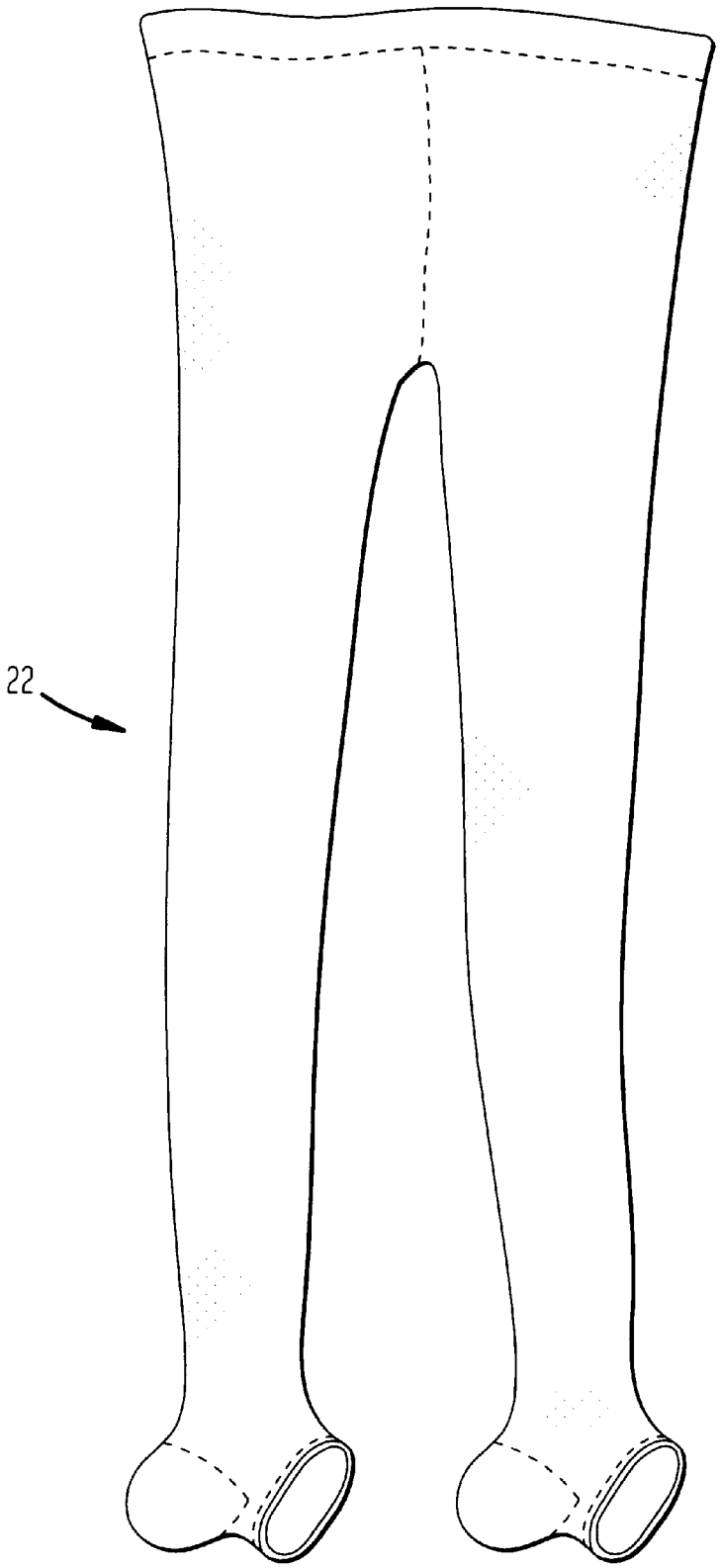
FIG. 1 is a diagrammatic front view of a pair of dancing tights having incorporated therein the convertible stocking of the present invention.
Figure 2:
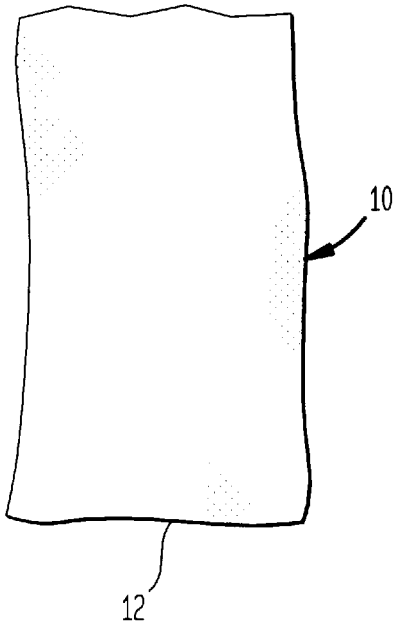
FIG. 2 is a diagrammatic side view of the main tubular portion prior to knitting of the toe pocket portion and foot opening collar.
Figure 3:
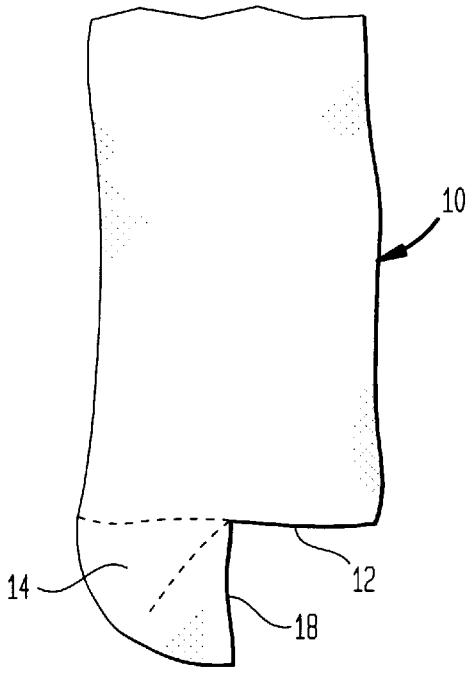
FIG. 3 is a diagrammatic side view of the main tubular portion and toe pocket portion prior to knitting of the foot opening collar.
Figure 4:
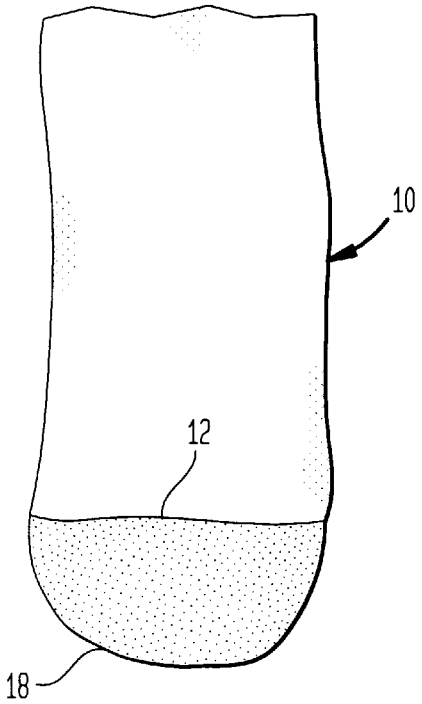
FIG. 4 is a diagrammatic front view of the main tubular portion and toe pocket portion prior to knitting of the foot opening collar.
Figure 5:
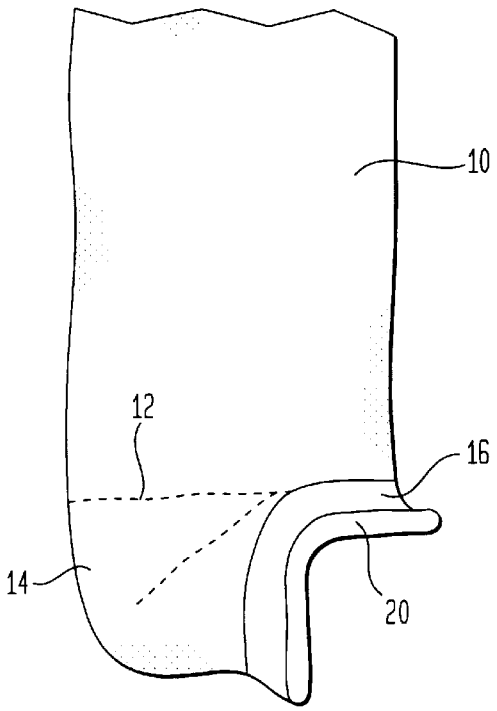
FIG. 5 is a diagrammatic side view of a convertible stocking having incorporated therein the foot construction of the present invention.
Figure 6:
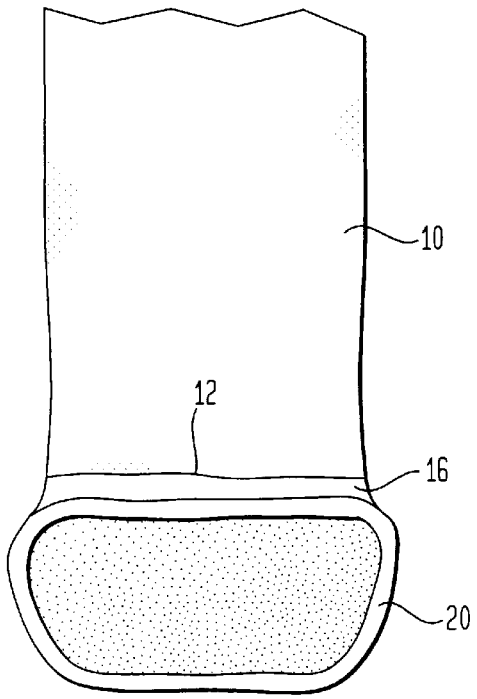
FIG. 6 is a diagrammatic front view of a convertible stocking having incorporated therein the foot construction of the present invention.

The stocking of the present invention is knitted on a continuous knitting machine having a reciprocating cylinder attachment for forming a toe pocket, such as a Singer-Fidelity Mark 3 circular knitting machine having 400 needles. This type of knitting machine has a main yarn feed and an auxiliary yarn feed.

Referring first to FIGS. 2, 3, 4, 5 and 6, the stocking is made by first knitting a main tubular portion 10. Main tubular portion 10 is knitted in a continuous circular manner using all 400 needles and both feeds. Preferably a waist band portion (not shown) is knitted using 30/2 denier nylon on every needle, and 70 denier lycra on every other needle. Preferably, the remainder of the main tubular portion is knitted of 70 denier lycra with an S twist yarn as the main feed and a Z twist yarn as the auxiliary feed. This is the conventional manner in which the main tubular portion or leg portion of stockings are knitted on this type of machine.

Once main tubular portion 10 is knitted, forming border 12 at one end, a toe pocket portion 14 is knitted to border 12 of main tubular portion 10 using a reciprocating cylinder attachment. In this operation, toe pocket portion is knitted using approximately 200 adjacent needles at border 12 in a reciprocating manner. The successive courses of yarn, preferably 70 denier lycra and 30/2 nylon, are fed by the main feed only and the number of needles used in the knitting are progressively decreased, preferably to 70 needles, and then progressively increased back to the original number of needles used at the beginning of the reciprocating operation. This forms a toe pocket over about one half the opening at border 12 of main tubular portion 10.

Figure 7:
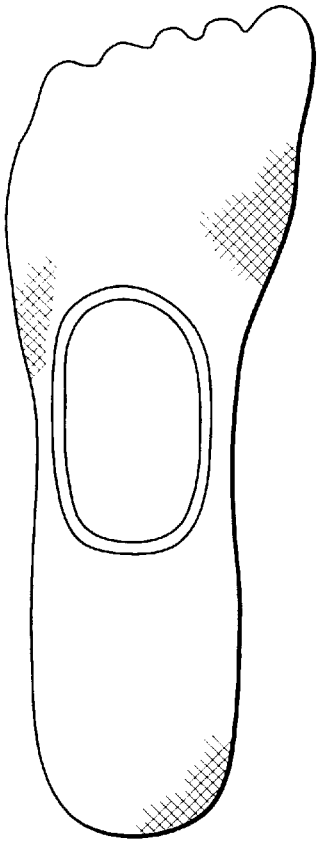
FIG. 7 is a bottom view of a foot in which the stocking is worn in a footed manner with the foot opening on the bottom of the foot.
Figure 8:
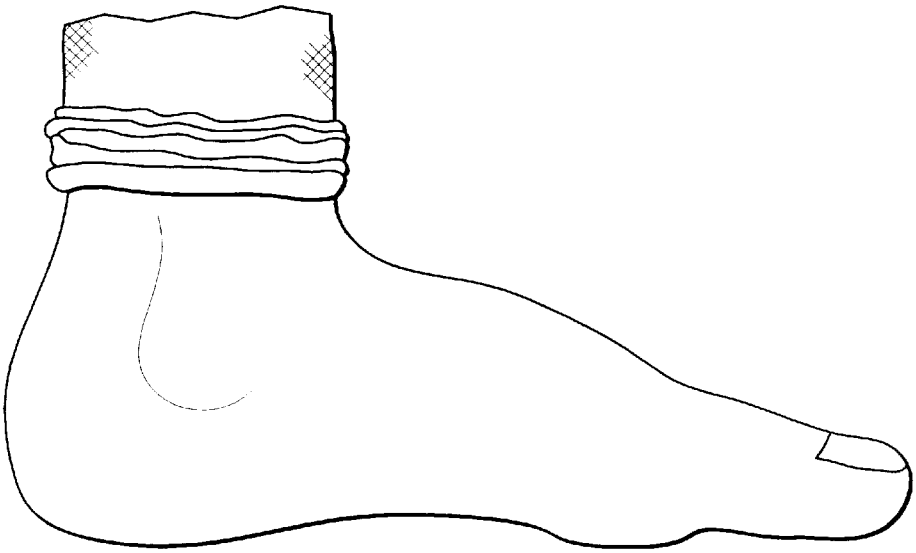
FIG. 8 is a side view of a foot in which the stocking is worn in a footless manner.

When toe pocket portion 14 has been formed, a continuous circular knitting operation is resumed using both feeds to form a foot opening collar 16 along the heretofore unknitted border of main tubular portion 10 and edge 18 of toe pocket portion 14. The main feed feeds 70 denier lycra and 30/2 denier nylon and the auxiliary feed feeds 70 denier lycra. Foot opening collar 16 is preferably a half inch wide. Preferably, the final courses along border 20 of collar 16 are knitted with nylon to prevent unravelling. When constructed in this manner, the foot opening is thereby positioned under the ball of the foot when the stocking is worn in a footed manner, as illustrated in FIG. 7.

Tights may be formed by knitting or sewing a pair of stockings together to form a waist band and crotch area. A pair of tights 22 according to the invention are shown in FIG. 1.

While yarns of various weights and thicknesses may be used in the invention, it has been found that 70 denier lycra and 30/2 denier nylon are preferred and provide the optimum stretchability and tension for use in dancing tights.

Although only a single embodiment of a convertible stocking of the invention is disclosed and described in detail, a skilled artisan will recognize many variations may be made in the arrangement and details of the invention, all without departing from the spirit and scope thereof as defined by the appended claims.

What is claimed is:

1. A tubular seamless stocking knitted on a circular knitting machine with reciprocating cylinders, said stocking having a main tubular portion, a toe pocket portion, and a foot opening collar wherein:

said main tubular portion is knitted in a continuous, circular manner to form a substantially uniform knit tube having a border at one end, said toe pocket portion is knitted in a continuous, reciprocating manner onto about one half of the border of the main tubular portion using successive courses of yarn beginning with about one half the total number of knitting needles of the knitting machine and progressively decreasing the number of knitting needles used to knit each course and then increasing the number of knitting needles to about one half the total number of knitting needles thereby forming a knitted pocket over about one half the border of the main tubular portion, said pocket having a terminating edge, and said foot opening collar comprises a tubular collar knitted in a continuous, circular manner to the remaining half of the border of the main tubular portion and to the edge of the toe pocket portion thereby providing an opening sufficient to permit the entire foot of the wearer to pass through the opening and wear the stocking alternatively in a footed or footless manner.

2. Dancing tights comprising a pair of stockings according to claim 1 attached together to form a waist band and crotch area.

3. A stocking according to claim 1, wherein the yarn used to knit the stocking is selected from the group consisting of: nylon of about 30/2 denier, lycra of about 70 denier and mixtures thereof.

4. Dancing tights according to claim 2, wherein the yarn used to knit the pair of stockings is selected from the group consisting of: nylon of about 30/2 denier, lycra of about 70 denier and mixtures thereof.

5. A method of using a convertible stocking by a wearer, comprising:

providing a tubular seamless stocking knitted on a circular knitting machine with reciprocating cylinders, said stocking having a main tubular portion, a toe pocket portion, and a foot opening collar wherein said main tubular portion is knitted in a continuous, circular manner to form a substantially uniform knit tube having a border at one end, said toe pocket portion is knitted in a continuous, reciprocating manner onto about one half of the border of the main tubular portion using successive courses of yarn beginning with about one half the total number of knitting needles of the knitting machine and progressively decreasing the number of knitting needles used to knit each course and then increasing the number of knitting needles to about one half the total number of knitting needles thereby forming a knitted pocket over about one half the border of the main tubular portion, said pocket having a terminating edge, and said foot opening collar comprises a tubular collar knitted in a continuous, circular manner to the remaining half of the border of the main tubular portion and to the edge of the toe pocket portion thereby providing an opening sufficient to permit the entire foot of the wearer to pass through the opening;

wearing said stocking alternatively in a footed or footless manner while the wearer is dancing.

6. A tubular seamless stocking knitted on a circular knitting machine with reciprocating cylinders, said stocking comprising a main tubular portion, a toe pocket portion attached to one end of the main tubular portion, and a foot opening collar comprising a tubular collar attached to the border of the main tubular portion and to the edge of the toe pocket portion, wherein said foot opening collar is adapted to provide an opening having sufficient size and stretchability to permit the entire foot of the wearer to pass through the opening thereby allowing the wearer to wear the stocking alternatively in a footed or footless manner.

7. Dancing tights comprising a pair of stockings according to claim 6 attached together to form a waist band and crotch area.

8. A method of using a convertible stocking by a wearer, comprising:

(a) providing a tubular seamless stocking knitted on a circular knitting machine with reciprocating cylinders, said stocking comprising a main tubular portion, a toe pocket portion attached to one end of the main tubular portion, and a foot opening collar comprising a tubular collar attached to the border of the main tubular portion and to the edge of the toe pocket portion, wherein said foot opening collar is adapted to provide an opening having sufficient size and stretchability to permit the entire foot of the wearer to pass through the opening;

(b) wearing said stocking alternatively in a footed or footless manner while the wearer is dancing.

* * * * *